United States Patent [19]

Middel et al.

[11] 4,379,427

[45] Apr. 12, 1983

[54] APPARATUS FOR APPLYING MARKS TO A PRODUCT E.G. A COIL OF ROLLED STEEL

[75] Inventors: Jan Middel, Barsingerhorn; Cornelis A. Gorter, Velsen-Noord, both of Netherlands

[73] Assignee: Estel Hoogovens B.V., Ijmuiden, Netherlands

[21] Appl. No.: 291,336

[22] Filed: Aug. 10, 1981

[30] Foreign Application Priority Data

Sep. 3, 1980 [NL] Netherlands ..... 8004984

[51] Int. Cl.[3] ..... B41F 17/20; B41F 17/06

[52] U.S. Cl. ..... 101/35

[58] Field of Search ..... 101/35, 4, 112, 114, 101/121, 122

[56] References Cited

U.S. PATENT DOCUMENTS

| | | | |
|---|---|---|---|
| 3,020,834 | 2/1962 | Brown et al. | 101/4 |
| 3,143,960 | 8/1964 | Naczynski | 101/121 |
| 3,545,376 | 12/1970 | Francis et al. | 101/121 |
| 3,584,573 | 6/1971 | Teplitz | 101/35 |
| 3,867,882 | 2/1975 | Ahlgren et al. | 101/35 |
| 4,106,435 | 8/1978 | Woodhouse et al. | 101/112 X |
| 4,253,393 | 3/1981 | Sato | 101/35 |

FOREIGN PATENT DOCUMENTS

| | | | |
|---|---|---|---|
| 2132371 | 1/1972 | Fed. Rep. of Germany | 101/122 |
| 55-124691 | 9/1980 | Japan | 101/35 |
| 440247 | 2/1975 | U.S.S.R. | 101/122 |

*Primary Examiner*—Clifford D. Crowder

*Attorney, Agent, or Firm*—Stevens, Davis, Miller & Mosher

[57] ABSTRACT

Marking apparatus especially for applying identifying marks to large coils, has a base 26 which is reciprocatingly moved along a track past the surface to be marked. Mounted on the base, so as to be movable transversely with respect to the base's movement, is a marking carriage 30 carrying marking means 36,37. In order to increase the area which can be marked and in particular to apply two lines of text, the carriage is mounted on the base by means of at least two spaced apart swivelling arms 29 which form an articulated quadrilateral such that the carriage is movable transversely between two limit positions with respect to the path of movement of the base.

5 Claims, 9 Drawing Figures

APPARATUS FOR APPLYING MARKS TO A PRODUCT E.G. A COIL OF ROLLED STEEL

BACKGROUND OF THE INVENTION

1. Field of the Invention

The invention relates to apparatus for applying marks to the surface of a product, especially the cylindrical surface of a coil of material such as rolled steel.

2. Description of the Prior Art

It is known for marks to be applied to a coil of rolled steel by means of a stencil and spray gun. This process is labour-intensive and, with a hot product, such as a coil of hot-rolled steel which has a temperature of e.g. 350° C., difficult and unpleasant for the marker. Another less difficult known method for marking products, is for alpha-numeric symbols to be applied to a product in the form of small dots sprayed by a matrix by programmed spray guns. The present invention is especially applicable to the design of apparatus for applying marks using these programmed spray guns or similar marking apparatus, but is not restricted to this application.

DAS No. 27 16 626 (Hoesch) discloses a spray gun for marking metal coils which is mounted on a carriage which moves along a segmental horizontal track. This track itself is movable vertically. By coordination of these movements, symbols can be written on the coil by the spray gun. A number of motors is required to control this apparatus, and its control is complex and delicate.

SUMMARY OF THE INVENTION

The object of the present invention is to provide apparatus with which two lines of text can be applied to a product in a short time, and which can be simple and robust in construction.

The apparatus according to the invention has a base which is moved along a path beside the product to be marked and a marking carriage carrying marking means mounted on the base by swivelling support arms which, with the carriage and base plate form an articulated quadrilateral, the carriage thus being arranged to move transversely e.g. in a plane at right angles to the direction in which the base travels, between two extreme positions at each of which a set of marks can be applied to the surface of the product.

An advantage of this is that two lines of text can be applied to the product with one set of marking and programming apparatus and with one marking agent supply system in a short time.

BRIEF DESCRIPTION OF THE DRAWINGS

Further advantages and optional characteristics of the invention will appear from the following description, with reference to the accompanying drawings, of a specific embodiment of apparatus in accordance with the invention.

In the drawings.

DESCRIPTION OF THE PREFERRED EMBODIMENT

Figure 1:
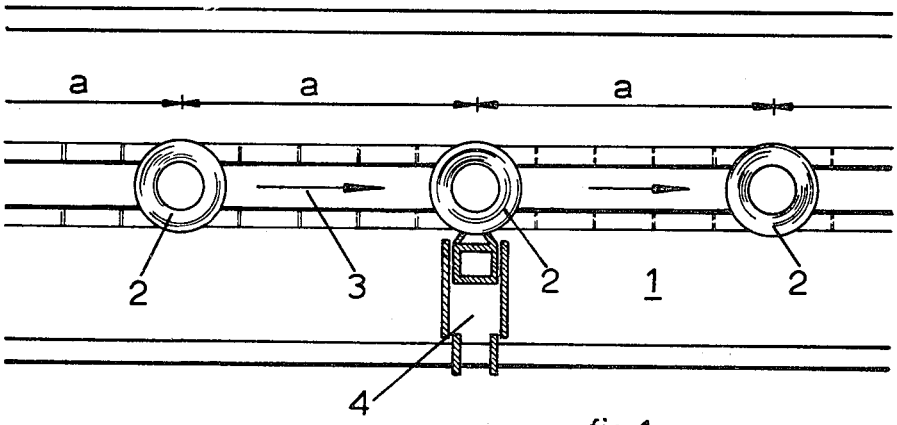
FIG. 1 is a top view of an exit table for coils of rolled steel.

FIG. 1 shows an exit table for example a chain conveyor, on which coils of rolled steel 2, e.g. hot rolled steel, are moved intermittently in a standing, i.e. eye-to-sky position with a spacing "a" in the direction of arrow 3. The marking apparatus of the invention is indicated at 4 in diagrammatic form. In a typical case, a maximum of 38 seconds is available for marking at the apparatus 4.

Figure 2:
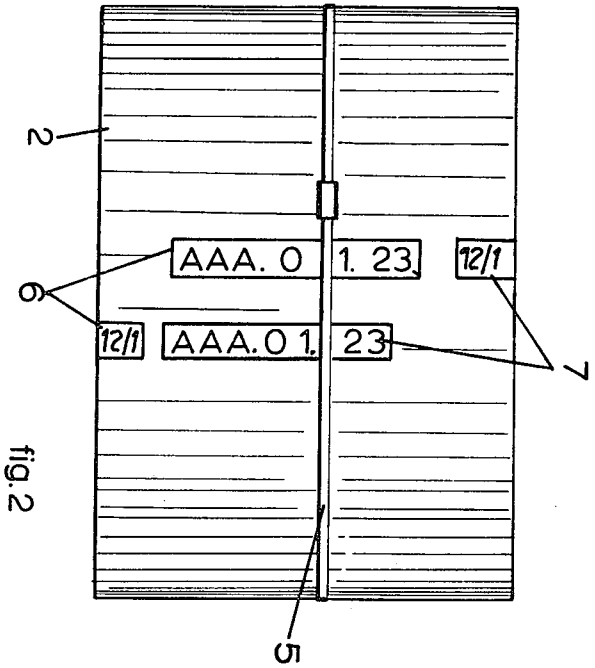
FIG. 2 is a side view of such a coil with a mark applied to it.

In FIG. 2 the cylindrical exterior of a coil 2 is shown provided with a central binding band 5 and marks which in one practical example consist of a series of white characters applied areas 6,7 of a blue base. The characters may be letters, digits or other symbols. The coil is between 1300 and 2000 mm in diameter and between 950 and 2000 mm in height. The base areas 6 and 7 may be 140×160 mm and 140×750 mm in size, respectively. The mark shown in FIG. 2 is of one practical type but its choice here is otherwise entirely arbitrary. The mark can extend over the full height of the coil. The two lines of characters may have a different text. The height of the characters and consequently of the base will depend on the apparatus used. For the marks shown as an example in FIG. 2, a base area is used to obtain a contrasting mark which remains clearly legible from a distance. The characters may if necessary be applied to the product without a base.

The marking apparatus shown in more detail in FIF. 3 has a fixed frame 8 built up from section girders and including two parallel vertical columns 9 with a suspension 10 at their top ends. The frame is suspended on a wall 11 alongside the exit table 1 and is adjusted in position by means of six adjustment bolts 12. Four of these adjustment bolts are at the top of the frame to ensure that the marking apparatus is firmly clamped to the wall. The frame 8 is adjusted by means of the other two adjustment bolts 12 which are at the lower end of the frame 8 so that it hangs vertically.

Figure 3:
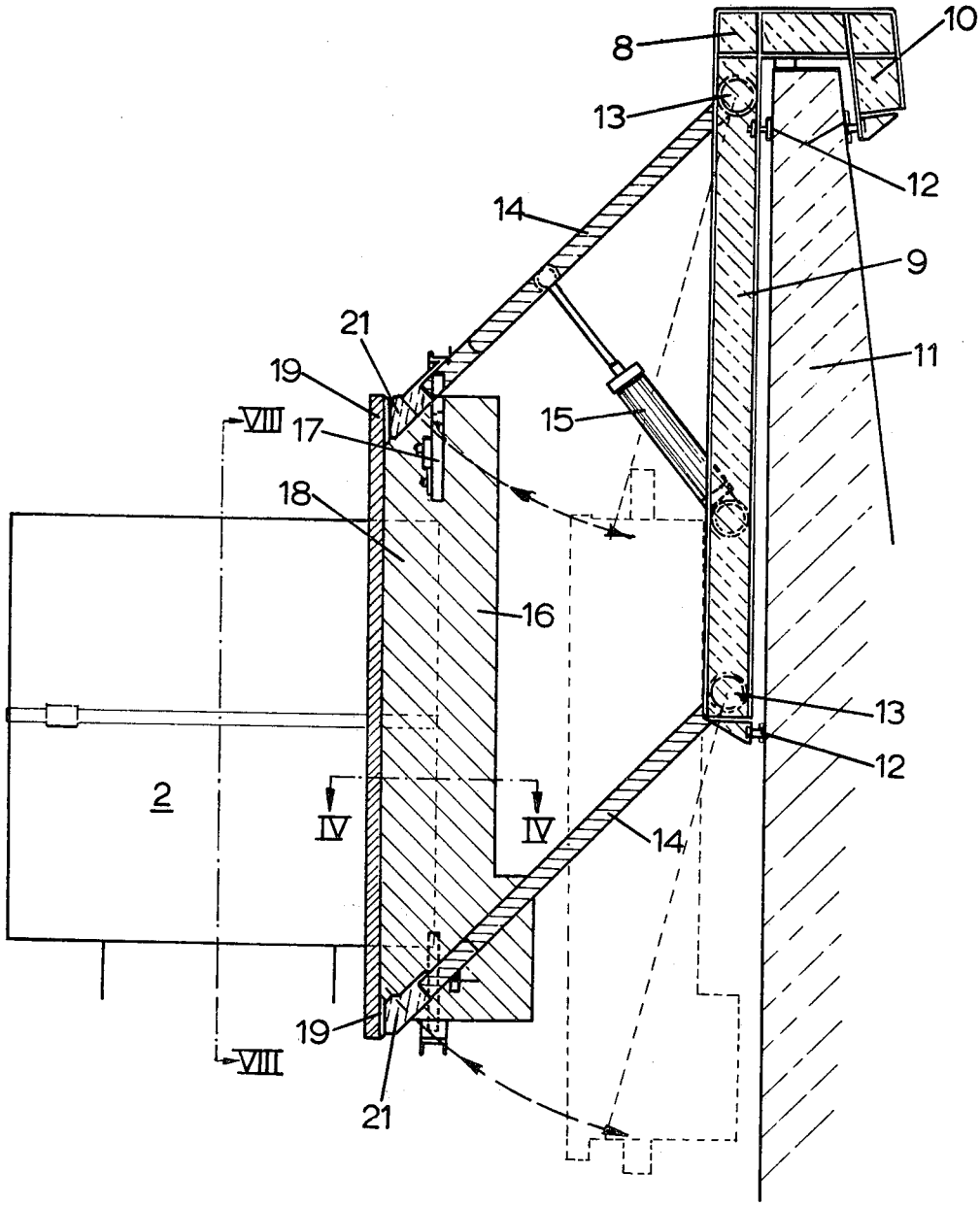
FIG. 3 is a diagrammatic side view of the marking apparatus embodying the invention.

The vertical columns 9 of the frame are further equipped with four pivots 13, two at the top and two at the bottom. Four swivelling arms 14 are fitted to these pivots 13. A box 16 is fastened to the other ends of the arms 14, being mounted vertically between the arms (it is shown hatched in FIG. 3). The arms 14 thus constitute a parallelogram linkage carrying the box 16. Two pneumatic cylinders 15 control the swivelling movement of the arms 14. In FIG. 3, the box 16 is drawn in the swivelled out position. The retracted position is indicated by broken lines. The box 16 contains a guidance and movement mechanism for a movable base 17 which is moved past the surface 18 of the coil 2 during marking.

Figure 4:
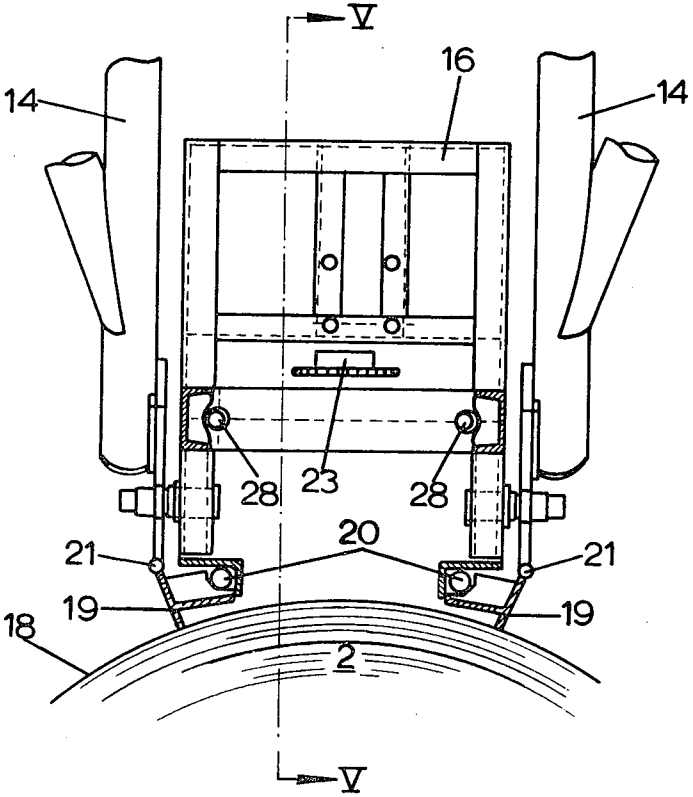
FIG. 4 is a cross section on the line IV—IV of FIG. 3.

FIG. 4 shows that the front of the box 16 is provided with an adjustable stop plate 19 on both vertical sides. These plates 19 are hingedly mounted on the box 16 by means of shafts 20 and are adjusted according to the diameter of the coil 2 to be marked by cam profiles 21 at the ends of the arms 14 (see also FIG. 3). These profiles 21 press against the backs of the hinged stop plates 19 to set the angle at which the plates 19 are pressed against the curvature of the coil 2. The cam profiles 21 are so shaped that the distance between the marking devices (to be described) and the surface 18 of the coil 2 remains the same whatever (within limits) the diameter of the coil to be marked.

Figure 5:
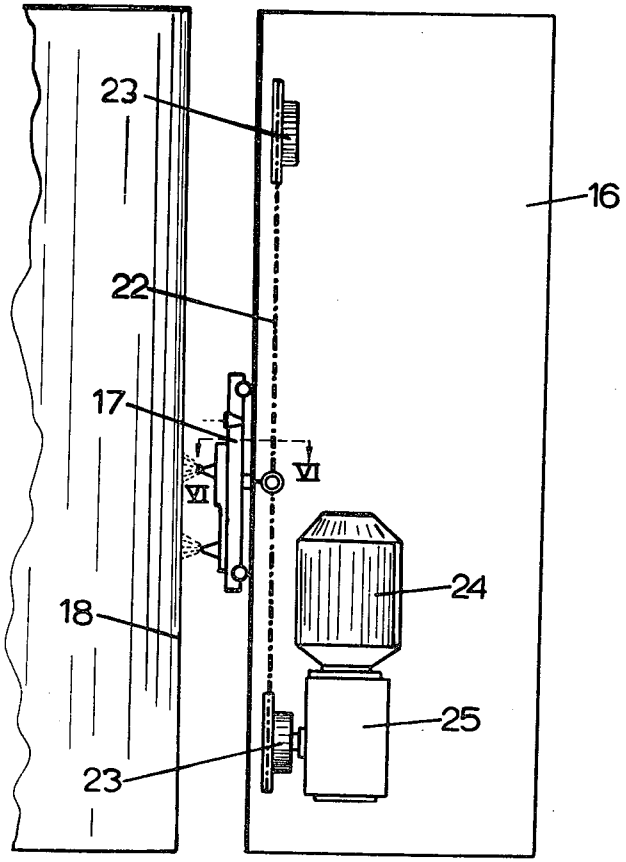
FIG. 5 is a diagrammatic cross section on the line V—V of FIG. 4.

As FIG. 5 shows, the mechanism for moving the movable base 17 contained in the box 16 consists of an endless chain 22 which is guided vertically around two sprocket wheels 23 mounted in the box. The lower sprocket wheel is driven by an electric motor 24 through a gearbox 25. The base 17 which is connected to the chain 22 can thus be moved up and down parallel to the outer surface 18 of the coil. To determine the position where the mark is to be sprayed, a pulse generator is coupled to the output shaft of the gearbox 25. This is used to measure the position of the base 17 relative to the coil, so that a micro-processor can calculate the distance (expressed in pulses) which the base has to cover before the mark should be sprayed.

Figure 6:
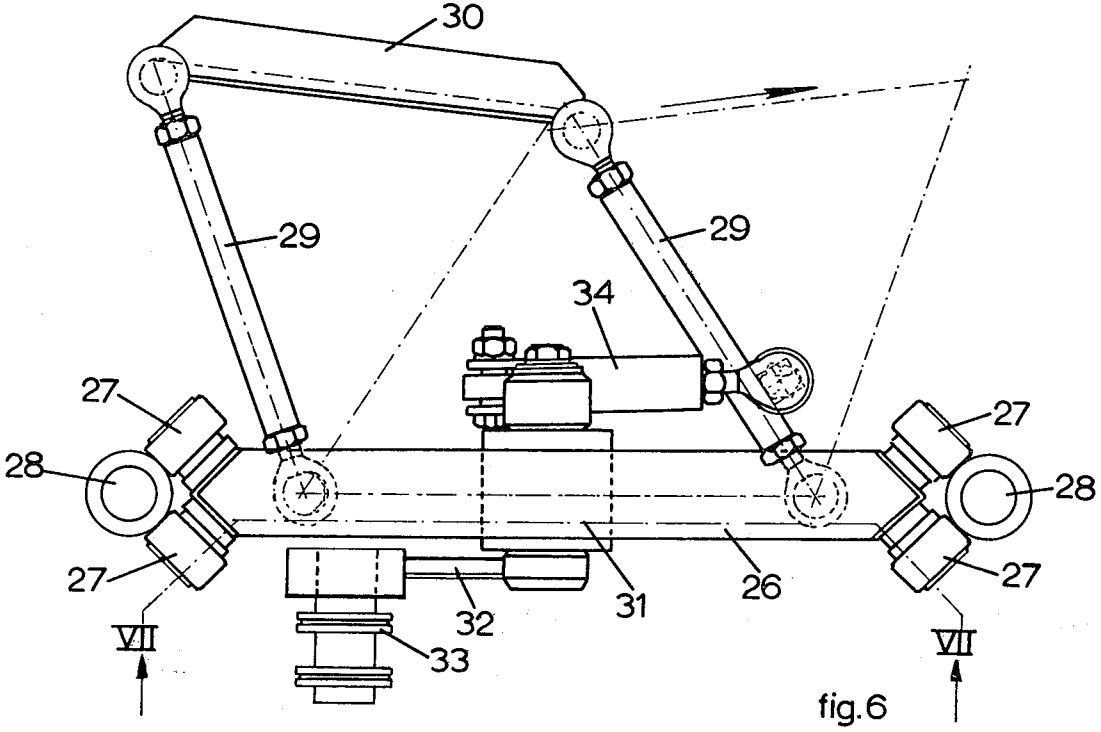
FIG. 6 is a cross section on the line VI—VI of FIG. 5.

FIG. 6 shows that the base 17, which during marking is moved past the coil by the chain 22, consists of a base plate 26 to which eight small wheels 27 are fitted on bearings. The wheels guide the vertical movement of the base by running along two round guide rails 28. The base plate 26 is connected to a marking carriage 30 by means of at least two but preferably four support arms 29 which are pivotally mounted at each end. The carriage 30, two arms 29 and the base plate 26 form an articulated quadrilateral aligned so that the carriage 30 can be moved in a plane at right angles to the direction of the path of movement of the base plate. One extreme or limit position of the carriage 30 is shown in FIG. 6. The other extreme position is indicated by chain dot lines. It can be seen that these two positions are symmetrical with respect to a plane which also bisects the plate 26.

Figure 7:
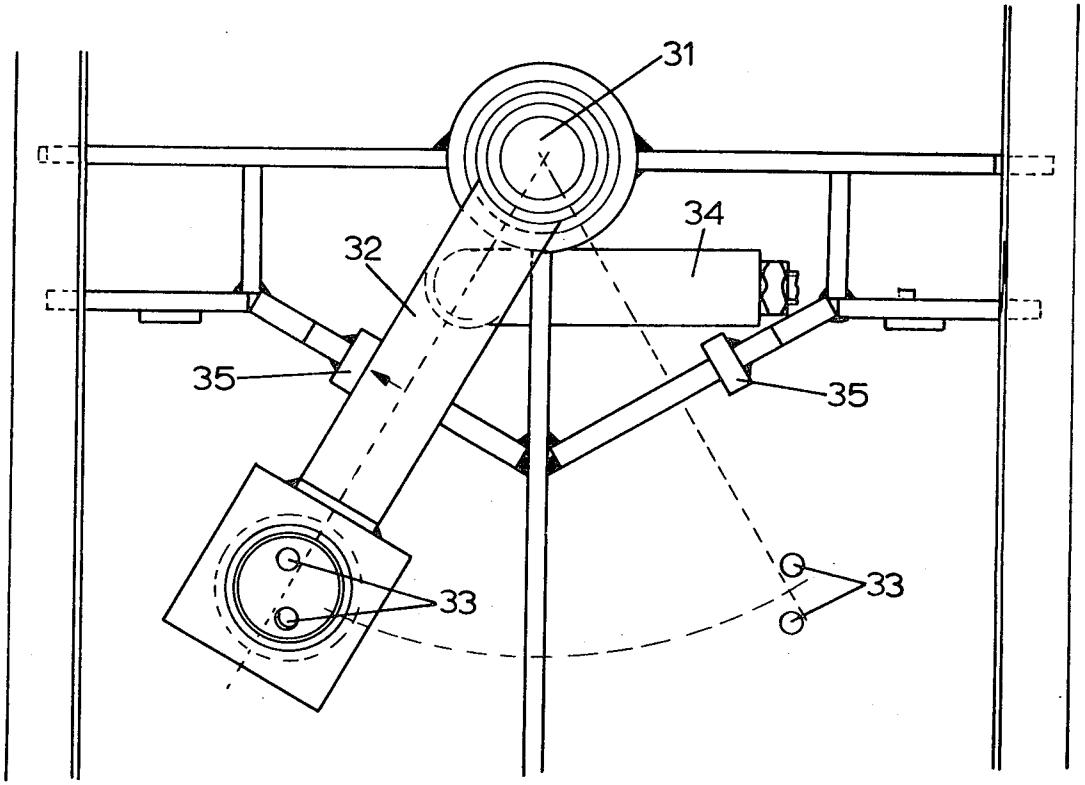
FIG. 7 is a section on the line VII—VII of FIG. 6.

A cranked connecting rod 32 which is pivotally mounted at 31 on the base plate 26 is seen in FIG. 7. At one end this rod 32 is pivotally connected with a link 33 in the chain 22. A swivelling lever 34 connects one of the support arms 29 to the other end of the connecting rod 32. This rod 32 serves (a) to cause the reciprocating movement of the base 26 in its fixed path and (b) to cause the movement of the assembly plate 30 from one extreme position to the other at right angles to the direction in which the base plate 26 travels when the link 33 passes round the bottom or top sprocket wheels. The marking carriage is prevented from rocking by two stops 35 (FIG. 7).

Figure 8:
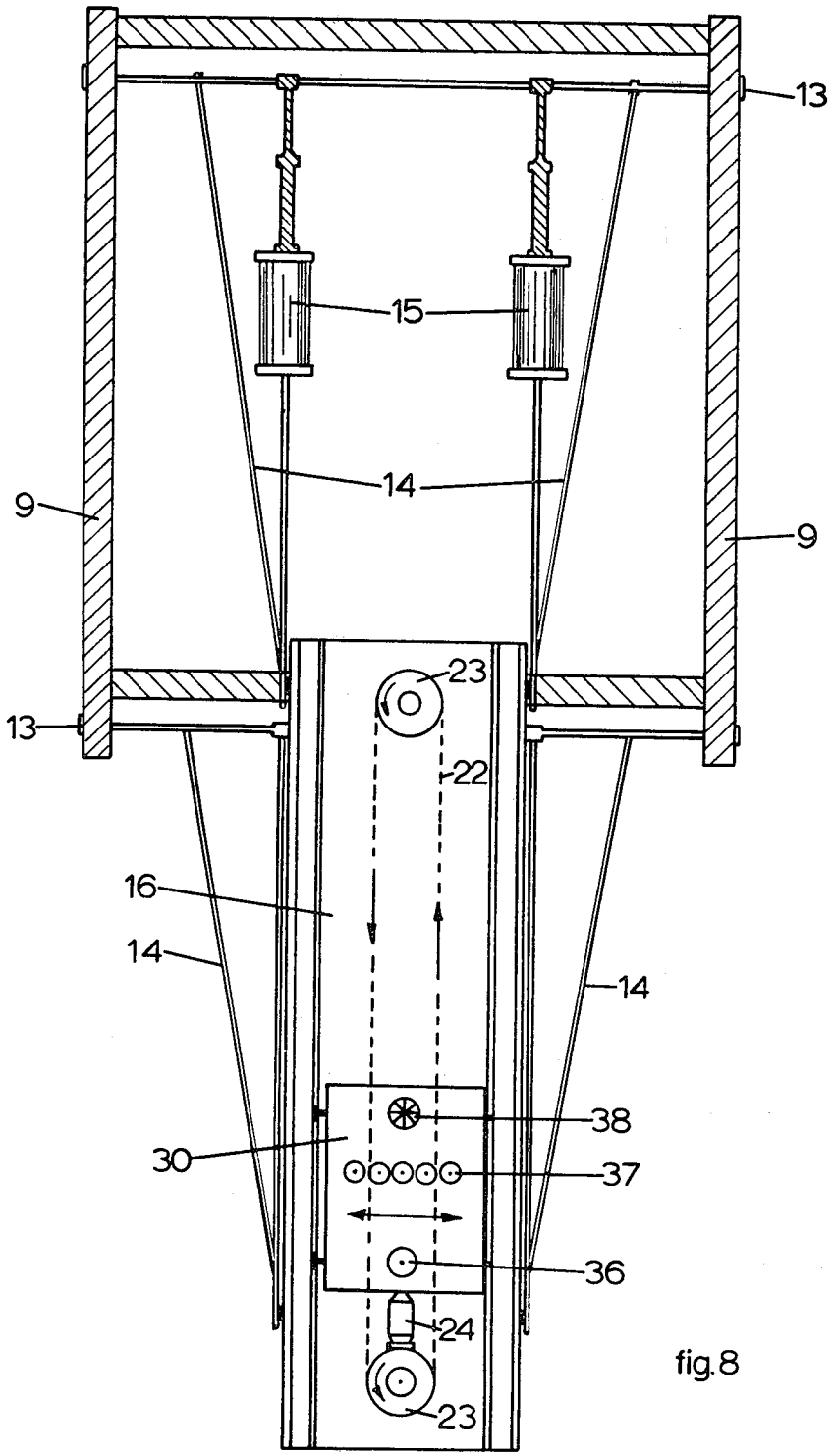
FIG. 8 is a front view in the direction indicated by arrows VIII—VIII in FIG. 3.

The front view of the marking machine in FIG. 8 shows the carriage 30 on which are mounted:

(i) a spray gun 36 for applying the blue base (if necessary) to the coil;

(ii) a set of five spray guns 37 for applying characters consisting of small dots, in this case in a 5×5 matrix, to the coil; and (iii) a photo-electric cell 38.

The function of the photo-electric cell is to signal the height of the coil during marking. A signal is given to the micro-processor, which then calculates when the second part of the mark should be sprayed onto the coil on the reverse movement of the base 26.

Figure 9:
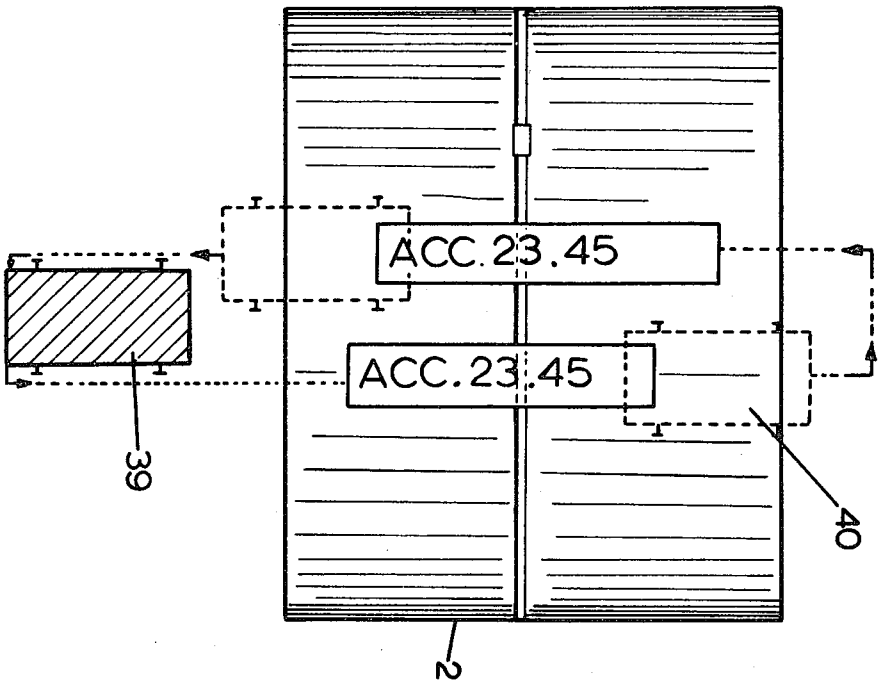
FIG. 9 shows diagrammatically the process involved in the marking of a coil.

The marking apparatus operates as follows (see FIG. 9):

(i) Marking is started when the coil 2 has arrived at the work position and the chain conveyor 1 stops.

(ii) The two pneumatic cylinders 15 are actuated, so that the box 16 is moved out of its retracted position (drawn in a broken line in FIG. 3) towards the coil 2 until the stop plates 19 are pressed gently against the roll.

(iii) On the first spraying cycle, during which the blues base 6,7 is applied to the coil, the base 17 rises from the bottom position 39 with the carriage 30 to the right of the centre line of the coil while the area of the first blue base is sprayed by the spray gun 36.

(iv) In position 40, the photo-electric cell 38 signals to a micro-processor that the top of the coil has been reached. The moment when spraying of the second area of the blue base is to be started on the downward movement of the base 26 is calculated from this signal.

(v) The assembly plate slews to the left when the base 26 reaches the top position. The base then moves downwardly and the spraying of the second background area is controlled by the micro-processor.

(vi) The second spray cycle during which the characters are applied to the base by the spray guns 37 proceeds in the same manner as the first spray cycle.

(vii) After spraying, the base returns to its bottom position 39 and the box 17 is returned to the retracted position by the pneumatic cylinders 15.

The procedure described above is completed in 26 seconds. Without the blue background, 16 seconds are required.

What is claimed is:

1. Apparatus for applying marks to the surface of a product, comprising (a) a base, (b) means for moving said base reciprocatingly along a path which path is adjacent the surface of the product to be marked, (c) a marking carriage, (d) marking means mounted on said marking carriage for applying marking material to the surface to be marked, (e) at least two swivellable support arms movably mounting said marking carriage on the base, the arms having first and second ends and being pivotally secured to the base at their first ends and pivotally secured to the marking carriage at their second ends at spaced apart points, thereby forming an articulated quadrilateral which is so aligned that the arms are swivellable transversely with respect to said path between two limit positions thereby carrying the marking carriage transversely with respect to said path so that said marking means can apply marks at at least two locations on said surface which are mutually laterally spaced with respect to said path.

2. Apparatus according to claim 1 including a driven endless element, turning wheels and wherein the base is moved reciprocatingly along its said path by means of said driven endless element which passes around said turning wheels at the opposite ends of the path, and the carriage is connected to a part of said endless element so as to be moved by the element from one said limit position to the other when said part passes round the turning wheels.

3. Apparatus according to claim 2 including a pivotable connecting rod and wherein the base is connected to said part of the endless element by a pivotable connecting rod so as to be moved in its path by said element, and one of said support arms is connected to said connecting rod so as to achieve said movement of the carriage by the element from one limit position to the other.

4. Apparatus according to claim 1 including a fixed frame, a movable box, guides, a parallelogram linkage interconnecting said frame and box and wherein the base is movable along guides carried by said movable box which is mounted on said fixed frame by said parallelogram linkage.

5. Apparatus for applying marks to the cylindrical surface of a coil of material, comprising a fixed frame, a movable box, guides carried by said movable box, a base movable on said guides along a path adjacent the surface of said coil of material to be marked, a marking carriage carried by said base and movable transversely to the path of movement of said base, said marking carriage mounted on said base by at least two swivelling support arms which, with the base and the marking carriage, form an articulated quadrilateral, whereby the carriage is movable transversely to the path of movement of the base between two limit positions in each of which a set of marks can be applied to the surface of said coil of material, a parallelogram linkage composed of pivoting arms having cam members interconnecting said frame and box, a pair of locating members which in use engage the cylindrical surface of the coil so as to position the box with respect to the coil, these locating members being rotatable about respective axes parallel to the coil axis, their rotation about said axes being limited by respective cam members carried by the pivoting arms of the said parallelogram linkage so that the spacing of the marking carriage from the coil surface when the locating members are pressed against that surface is substantially constant irrespective of the coil diameter.

* * * * *